United States Patent [19]

Rebel

[11] 4,372,244

[45] Feb. 8, 1983

[54] VARNISHING UNITS ON PRINTING PRESSES

[75] Inventor: Herbert Rebel, Rodgau, Fed. Rep. of Germany

[73] Assignee: M.A.N.-ROLAND Druckmaschinen Aktiengesellschaft, Fed. Rep. of Germany

[21] Appl. No.: 328,531

[22] Filed: Dec. 8, 1981

[30] Foreign Application Priority Data

Dec. 8, 1980 [DE] Fed. Rep. of Germany ..... 3046257

[51] Int. Cl.[3] ..... B05C 1/16

[52] U.S. Cl. ..... 118/46; 118/222; 118/262

[58] Field of Search ..... 118/204, 221, 222, 262, 118/46

[56] References Cited

U.S. PATENT DOCUMENTS

| | | | |
|---|---|---|---|
| 3,552,311 | 1/1971 | Petri | 101/148 |
| 3,789,795 | 2/1974 | Brandenburg | 118/204 X |
| 4,270,483 | 6/1981 | Butler et al. | 118/46 |

*Primary Examiner*—Evan K. Lawrence

*Attorney, Agent, or Firm*—Leydig, Voit, Osann, Mayer & Holt, Ltd.

[57] ABSTRACT

A varnishing unit for applying varnish in a strip of selected width on a sheet carried on the impression cylinder of a printing press distinguished by use of a plurality of adjustable varnish blocking rollers arranged adjacent a fountain roller between a varnish trough and a metering nip formed between a metering roller and the fountain roller. The blocking rollers are hard surfaced and of relatively small diameter, and are secured to the frame by arms located at the respective ends of each roller. Each blocking roller is individually adjustable between (a) a position in which it forcibly indents the surface of the fountain roller so as to substantially cut off the flow of varnish to the metering nip, in the region of width controlled by the blocking roller and (b) a position withdrawn from the surface of the fountain roller to permit passage of a strip of varnish in the controlled region to the metering nip and thence via intermediate rollers to the varnishing cylinder. The arms can be differentially adjusted so that the flow of varnish may be blocked off at one end of the roller but not at the other to achieve a varnish strip of a width which is less than the length of the blocking roller. Furthermore, the arms on which the blocking rollers are mounted are slidable on a cross beam which extends parallel to the fountain roller to permit adjustment of the position of the region controlled by the blocking roller.

4 Claims, 5 Drawing Figures

VARNISHING UNITS ON PRINTING PRESSES

When printing pages requiring a glossy finish, as is common in many of today's magazines and catalogues, a varnish must be applied to the printed sheet to provide the gloss. As is well known in the art, varnish is transferred through a series of rollers to a varnishing cylinder, which rollingly engages an impression cylinder to transfer the varnish to the printed matter carried by the impression cylinder. However, a problem has arisen when sheets of various size are sought to be varnished. There has not been a satisfactory way to use a single varnishing unit to apply varnish to sheets of different width, or to apply varnish in a strip of a desired width and location on a sheet.

It is, accordingly, an object of the present invention to provide a varnishing unit for a printing press which can be used to apply varnish to printed sheets of various width or in a strip of desired width and location. It is a related object to provide a varnishing unit in which the working areas of the rollers which transfer the varnish to the varnishing cylinder can be quickly and easily adjusted. A further object lies in the provision of an adjustable width varnishing unit which is both economical and simple to make and operate.

More specifically, it is an object of the present invention to provide blocking rollers which are adjustable both endwise and in skewed engagement with a fountain roller to selectively control the working areas of the fountain roller, its metering roller, and other rollers which carry the varnish eventually transferred to the varnishing cylinder for application to the printed matter.

Other objects and advantages of the invention will become apparent upon reading the attached detailed description and upon reference to the drawings in which.

While the invention will be described in connection with a preferred embodiment, it will be understood that there is no intention to limit the invention to the construction shown but, on the contrary, but it is intended to cover the various alternative and equivalent constructions included within the spirit and scope of the appended claims.

Figures 1, 3:
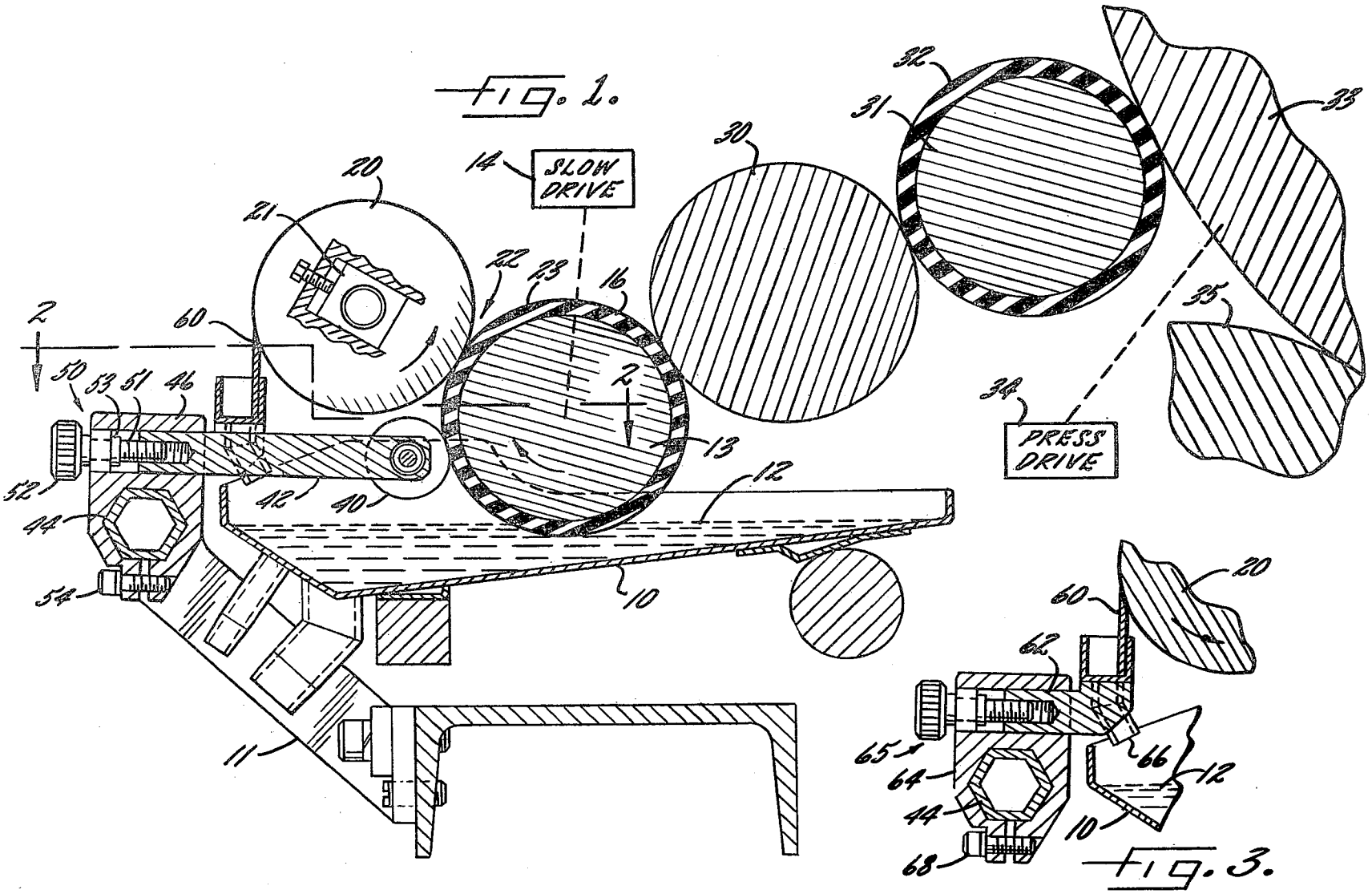
FIG. 1 is a vertical cross-sectional view taken generally along line 1—1 in FIG. 2 showing a varnishing unit embodying the present invention.
FIG. 3 is a fragmentary section taken along line 3—3 of FIG. 2 showing a scraper blade forming part of the present invention.
Figure 2:
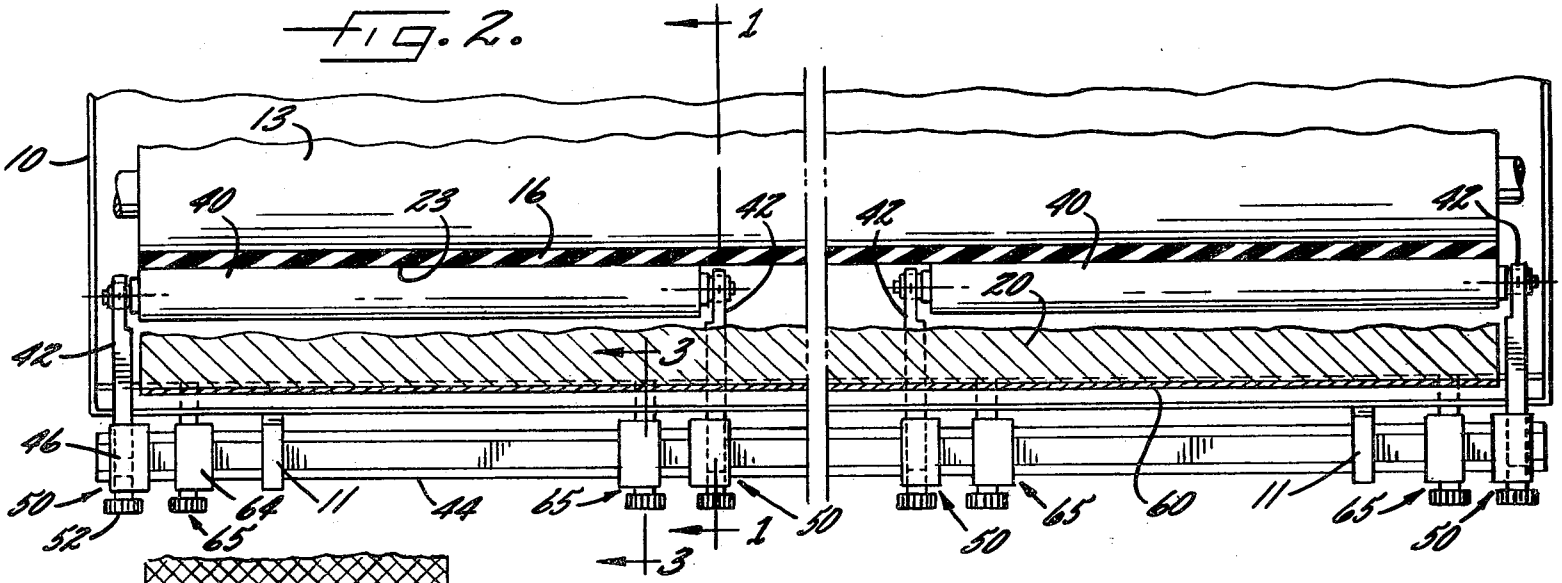
FIG. 2 is a plan view in partial section taken generally along line 1—1 in FIG. 1.

Turning now to FIG. 1, there is shown a typical varnishing unit having a trough 10, supported by a frame 11, for holding the varnish supply 12, and a fountain roller 13 which is partially immersed in the varnish supply so that, upon rotation of the fountain roller 13 by a slowly rotating driving means 14, the entire submerged length of the fountain roller 13 will be coated with varnish. The fountain roller 13 is provided with a resilient surface layer 16 and is rollingly engaged by a hard-surfaced metering roller 20 to form a metering nip 22. The metering roller 20 includes means 21 for adjusting the degree of indentation of the metering roller upon the fountain roller. The degree of this indentation determines the thickness of the film of varnish 23 which will cling to the fountain roller 13 on the downstream side of the metering nip 22.

Downstream of the metering nip 22, the fountain roller 13 is engaged by a hard-surfaced distributor roller 30. The distributor roller 30 accepts the film of varnish from the fountain roller 13 and in turn transfers the film to a form roller 31 having a resilient surface layer 32, which is mounted for rolling engagement with the distributor roller 30. The form roller 31 in turn transfers the film of varnish to a varnishing cylinder 33, which is driven by a press drive 34. The varnishing cylinder 33 is arranged for engagement with a sheet of printed matter (not shown) carried on a conventional impression cylinder 35, shown symbolically, so that the film of varnish carried by the varnishing cylinder 33 is applied to the sheet. Slippage occurs between rollers 13 and 30.

In carrying out the present invention, a plurality of varnish blocking rollers 40 are arranged adjacent the fountain roller 13 between the varnish trough 10 and the metering nip 22 when viewed in the direction of rotation of the fountain roller. The blocking rollers 40 are hard surfaced and of relatively small diameter in comparison with the fountain roller 13. The blocking rollers 40 are mounted to the frame 11 and have adjusting means for individual adjustment of each blocking roller between (a) a position in which the blocking roller forcibly indents the resilient surface of the fountain roller to substantially cut off the flow of varnish to the metering nip 22 in the indented region of the fountain roller, and (b) a position in which the blocking roller 40 is withdrawn from engagement with the fountain roller 13 to permit a passage of a film of varnish on the section of the fountain roller which is potentially engageable with the blocking roller 40. This film of varnish travels through the metering nip 22 and is eventually transferred to the varnishing cylinder 33 for application to the sheet on the impression cylinder 35. Thus, each blocking roller 40 defines a controlled region of width on the fountain roller for the transmission of varnish.

Figure 5:
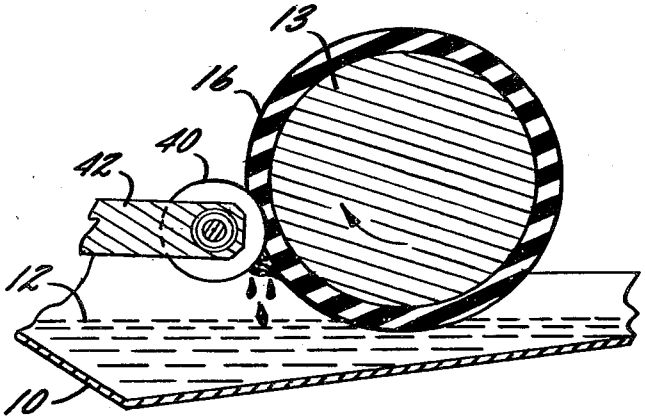
FIG. 5 is a fragmentary section taken along line 5—5 in FIG. 4 showing the blocking effect of the blocking roller.

More specifically, each blocking roller 40 is journaled at its respective ends by a pair of arms 42. These arms 42 are secured to a cross beam 44 through brackets 46, the cross beam 44 being secured to the frame 11 and extending parallel to the fountain roller 13. Each bracket 46 mounts an arm adjusting mechanism 50 which includes a threaded screw 51 having a knob 52 and a collar 53. The threaded screw 51 engages the internal threads of a bore in each arm 42, while the collar holds the screw captive in the bracket. By rotating the knob 52, and thus either screwing the thread 51 into or out of the threaded bore in the arm 42, the blocking roller can be either moved into engagement with, or away from, the fountain roller 13. As shown in FIG. 5, the arms may be adjusted so that the blocking roller 40 forcibly indents the surface of the fountain roller 13 so that the flow of varnish is substantially completely blocked off, with the intercepted varnish simply dripping back into the trough.

Because no varnish will be carried on the resilient surface 16 of the fountain roller 13 which is indentedly engaged by a blocking roller 40, the region or zone of the fountain roller 13 which does not transmit a film of varnish can be varied by selective engagement of a blocking roller. Thus, the width of the film of varnish, and the active regions of the rollers over which it is transmitted, can be adjusted so that a film of varnish is applied to only a selected portion of the varnishing cylinder 33.

Also in keeping with the present invention, each bracket 46 is clamped to the cross beam 44 with a screw 54. With these clamping screws 54 loosened, the brackets 46 and their corresponding arms 42 can be shifted along the cross beam 44 to achieve endwise adjustment of each blocking roller, thus permitting endwise adjustment of the position of the region controlled by the blocking roller for control of the flow of varnish to the surface of the varnishing cylinder. The present device thus permits a strip of varnish of selected widtih to be carried at a selected position on the fountain roller for eventual transmission to the impression cylinder of a printing press.

In practicing the invention, a scraper blade 60 engages the metering roller 20 on the downstream side of the nip 22 to scrape off varnish which clings to the metering roller 20, returning it to the trough 10. The scraper blade 60 allows the metering roller 20 to act on the fountain roller 13 without affecting the varnish-free areas of the fountain roller, as any residual varnish has been substantially removed from the metering roller. As best seen in FIG. 3, the resilient scraper blade 60 is held by arms 62, which are in turn held in adjustable brackets 64 mounted on the cross beam 44. The arms 62 are mounted for movement within the bracket 64 in an adjusting device 65 similar to that disclosed at 50 with respect to the arms which hold the blocking rollers. The adjustability of the radial position of the scraper blade permits the blade to be moved in concert with the metering roller 20, as the metering roller is moved to vary the degree of its indentation upon the fountain roller, which varies the quantity of varnish carried by the fountain roller.

The scraper blade 60 transmits the varnish scraped off the metering roller 20 back into the varnish trough 10 through a return channel 66, which is held by the arms 62. Similarly to the brackets 46 disclosed in conjunction with the blocking rollers, brackets 64 are also slidable along the length of the cross beam 44. Each bracket 64 has a clamping screw 68 which, when a desired position of the slidable bracket 64 is reached, can be tightened to securely hold the scraper blade in its desired position. A single scraper blade which extends over the full length of the metering roller is preferred, although multiple scraper blades may be employed if desired, one corresponding to each blocking roller. The removal of the excess varnish on the metering roller by the scraper blade insures that no varnish can be recirculated on the on the metering roller back to the metering nip.

Figure 4:
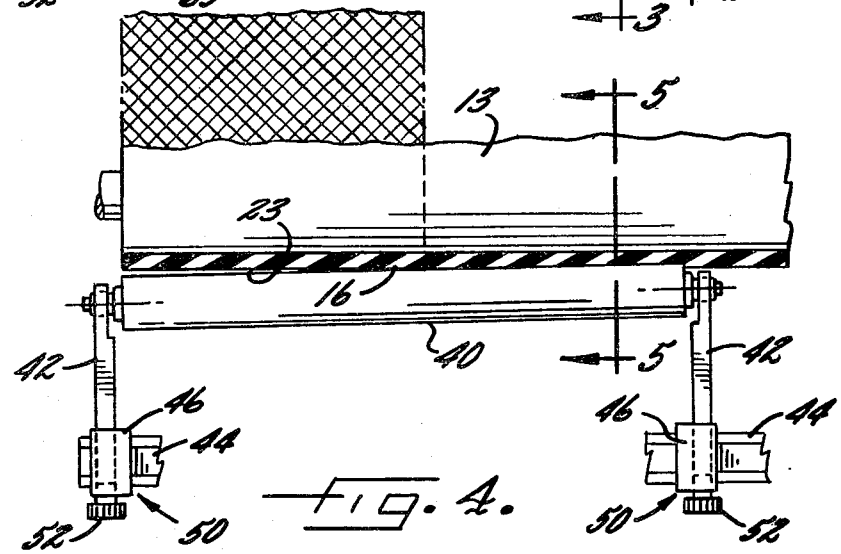
FIG. 4 is a partial plan view, similar to the view in FIG. 2, showing a blocking roller adjusted to permit varnish to be transmitted only over a narrow width on the fountain roller.

In keeping with the invention, each arm adjusting mechanism 50 can be independently manipulated so that one end of its corresponding blocking roller 40 forcibly indents the surface of the fountain roller 13 to block off, at that end, the flow of varnish to the metering nip 22, while the other end of the blocking roller is withdrawn from the fountain roller 13 by its arm adjusting mechanism 50. This is best shown in FIG. 4 and allows for a strip of varnish of a width less than the length of the blocking roller 40 (indicated by the cross-hatching in FIG. 4) to be transferred by the fountain roller 13 to, eventually, the varnishing cylinder 33 for application to a sheet on the impression cylinder 35. Thus, by selectively adjusting the portion of a blocking roller 40 which engages the fountain roller 13, the varnish strip which is carried by the fountain roller can be varied to any length less than the length of the blocking roller.

It will be apparent that the objects of the invention have been amply fulfilled. The blocking rollers 40 mounted on slidable adjustable arms 42 and brackets 46 permit a strip of varnish of a selected width to be carried by a selected region of the fountain roller for application to a sheet of printed material carried by the impression cylinder.

I claim:

1. A varnishing unit for applying varnish in a strip of selected width on a sheet carried on the impression cylinder of a printing press comprising, in combination, a frame, a varnishing cylinder arranged for engagement with the sheet on the impression cylinder, a varnish trough, a resiliently surfaced fountain roller, driving means for slowly rotating the fountain roller in the varnish in the trough, a hard surfaced metering roller in rolling engagement with the fountain roller to form a metering nip, means for adjusting the degree of indentation of the metering roller upon the fountain roller thereby to determine the thickness of the film of varnish which clings to the fountain roller on the downstream side of the nip, a scraper blade on the metering roller on the downstream side of the nip for scraping off the varnish which clings to the metering roller for return thereof to the trough, a hard surfaced distributor roller in engagement with the fountain roller downstream of the nip for accepting the film of varnish, a resilient form roller in rolling engagement with the distributor roller for transferring the film to the varnishing cylinder, and a plurality of varnish blocking rollers arranged adjacent the fountain roller between the trough and the metering nip, the blocking rollers being hard-surfaced and of relatively small diameter, means including arms at the respective ends of each roller and secured to the frame for supporting the blocking rollers end to end so that each defines a region of width on the fountain roller for control of varnish flow, the arms having adjusting means for individual adjustment of each blocking roller between (a) a forcibly indented position on the surface of the fountain roller sufficient to substantially cut off the flow of varnish to the metering nip in the region of width controlled by the blocking roller and (b) a withdrawn position permitting passage of a strip of varnish in the controlled region to the metering nip and thence to the varnishing cylinder, the adjusting means at each end of a blocking roller being differentially adjustable so that flow of varnish may be blocked off at one end of the blocking roller but not at the other thereby to achieve a varnish strip of a width which is less than the length of the blocking roller.

2. The combination as claimed in claim 1 in which the frame of the press has a cross beam extending parallel to the fountain roller, the supporting arms being slidably mounted on the cross beam to achieve endwise adjustment of each blocking roller thereby to adjust the position of the region controlled by the blocking roller for control of flow of varnish to the surface of the varnishing cylinder.

3. The combination as claimed in claim 1 in which the scraper blade extends over the full length of the metering roller.

4. The combination as claimed in claim 2 in which adjustable brackets are provided for mounting the scraper blade, the adjustable brackets being mounted upon the cross beam and having provision for adjustment with respect thereto.

* * * * *